US007473055B2

(12) United States Patent
Sheridan

(10) Patent No.: US 7,473,055 B2
(45) Date of Patent: Jan. 6, 2009

(54) WATER RETENTION SYSTEM

(75) Inventor: Terence G. Sheridan, Rumson, NJ (US)

(73) Assignee: Geostorage Corporation, Rumson, NJ (US)

( * ) Notice: Subject to any disclaimer, the term of this patent is extended or adjusted under 35 U.S.C. 154(b) by 522 days.

(21) Appl. No.: 11/190,629

(22) Filed: Jul. 27, 2005

(65) Prior Publication Data

US 2007/0025817 A1 Feb. 1, 2007

(51) Int. Cl.
*E02B 11/00* (2006.01)

(52) U.S. Cl. ..... 405/53

(58) Field of Classification Search ..... 405/53, 405/55

See application file for complete search history.

(56) References Cited

U.S. PATENT DOCUMENTS

| | | | | | |
|---|---|---|---|---|---|
| 3,501,917 | A | | 3/1970 | Delter | |
| 3,704,593 | A | * | 12/1972 | St. Clair | 405/55 |
| 4,366,846 | A | | 1/1983 | Curati, Jr. | |
| 4,425,743 | A | * | 1/1984 | Bartur | 52/169.5 |
| 4,592,846 | A | | 6/1986 | Metzger et al. | |
| 4,620,817 | A | | 11/1986 | Cushing | |
| 4,793,146 | A | * | 12/1988 | Ryokai | 62/260 |
| 5,080,528 | A | | 1/1992 | Ressi di Cervio | |
| 5,108,225 | A | | 4/1992 | Neal | |
| 5,201,606 | A | | 4/1993 | Davis et al. | |
| 5,246,308 | A | | 9/1993 | Brothers | |
| 5,810,510 | A | | 9/1998 | Urriola | |
| 5,823,711 | A | | 10/1998 | Herd et al. | |
| 5,890,838 | A | * | 4/1999 | Moore et al. | 405/49 |
| 6,350,374 | B1 | | 2/2002 | Stever et al. | |
| 6,626,609 | B1 | | 9/2003 | Kotani et al. | |
| 6,638,424 | B2 | | 10/2003 | Stever et al. | |
| 6,702,517 | B2 | | 3/2004 | Goddard | |
| 6,796,325 | B1 | | 9/2004 | Courier | |
| 6,991,402 | B2 | | 1/2006 | Burkhart | |
| 2003/0021630 | A1 | | 1/2003 | Norman, et al. | |

FOREIGN PATENT DOCUMENTS

| | | | |
|---|---|---|---|
| JP | 2000-001899 | A | 1/2000 |
| JP | 2002-309628 | A | 10/2002 |

* cited by examiner

*Primary Examiner*—John Kreck
(74) *Attorney, Agent, or Firm*—Alan Taboada

(57) ABSTRACT

An improved water retention/detention system is provided which is comprised of a chamber formed by stabilized porous perimeter means and a roof, with support means within the chamber, and a liner effective to prevent particulates from passing into said chamber and porous perimeter means.

47 Claims, 8 Drawing Sheets

WATER RETENTION SYSTEM

BACKGROUND OF THE INVENTION

1. Field of the Invention

The present invention relates to an improved underground water retention/detention system comprised of a roof supported by stabilized porous perimeter structures constructed with open graded aggregate and columns/piers enclosed in a liner system.

2. Description of the Prior Art

Water retention/detention systems store and release water at a controlled rate in accordance with increasingly stringent environmental requirements. Storm water retention/detention systems have become standard features on site development projects where buildings, roads and parking lots have limited the site's ability to absorb water. In response, many state and municipal agencies have limited the rate at which storm water can be discharged into local streams. A detention pond is often constructed at new developments to store and release water at a designated rate. Where land is valuable or where space is limited or where other concerns are present retention/detention systems are constructed underground. See, for example, U.S. Pat. Nos. 6,796,325, 4,620,817 and 6,702,517.

In accordance with prior procedures, engineers have provided various means for directing storm water into the earth for storage and disposal. For example crushed stone pits have been employed, frequently with perforated pipes therein. Various shaped or molded structures made of concrete, steel or plastic have been employed.

Large diameter pipes have traditionally been used to construct below grade retention/detention systems. Typically these systems involve a series of parallel pipes placed on a prepared bed at the bottom of an excavation. The pipes must be adequately spaced, backfilled with a select soil and covered to a minimum height.

As a result of the backfill requirements and the limited capacity of pipes, these systems often require more area than is desired or available. As an alternative to traditional underground retention/detention systems the present invention proposes to decrease the required footprint and/or provide an economical alternative among other advantages.

Prior systems have taken up large areas and/or have involved the use of elaborate and costly components. Improved underground retention/detention systems remain an important objective.

BRIEF DESCRIPTION OF THE INVENTION

In accordance with the present invention, improved water retention/detention systems are provided which meet the criteria of durability and low cost as well as ease of assembly while having the integrity to support loads imposed by other users on the land surface such as automobile parking and driving.

Essentially the water retention/detention system of the invention comprises a roofed underground chamber for water storage, the perimeter structures of which are constructed of porous fill materials and stabilized, the chamber roof being supported both by the perimeter structures and by interior columns or piers where needed. The perimeter structures as later described are constructed with open graded aggregate. A liner system is provided to separate the water retention system of the invention from the surrounding soil. The columns/piers may be constructed with open graded aggregate or with conventional metal, concrete, plastic or the like materials.

The stabilized porous perimeter structures can be mechanically stabilized earth walls (MSEW) or reinforced soil slopes (RSS). The open graded aggregate is an inert material such as sand, gravel, lightweight aggregate, expanded shale, broken stone, slag, shell or combinations thereof. The liner system can be a geomembrane or geotextile.

DESCRIPTION OF THE DRAWINGS

FIG. 6 is a plan view showing various features of a retention/detention chamber according to the invention while

DETAILED DESCRIPTION

Figure 1:
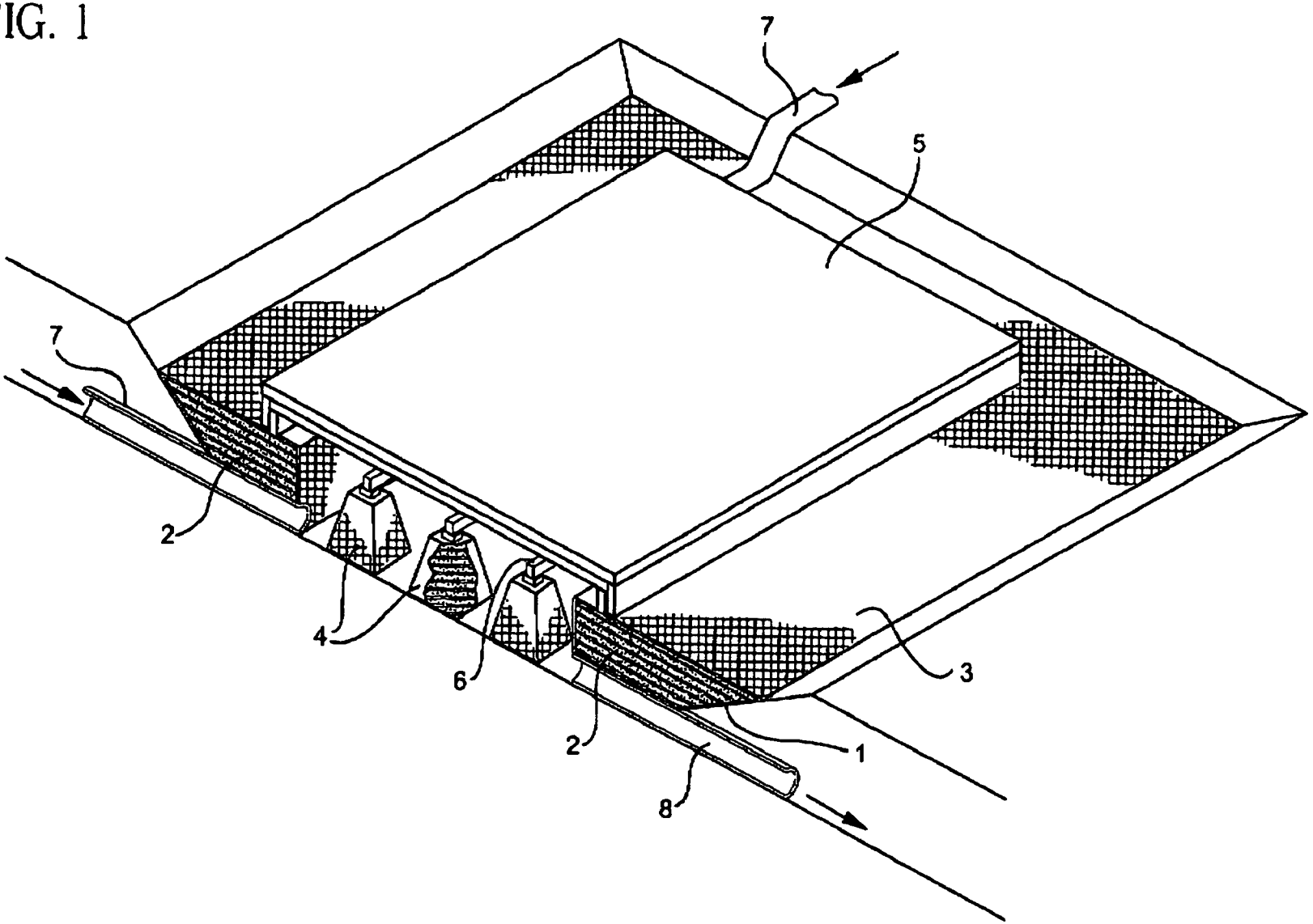
FIG. 1 is a perspective view illustrating a water retention/detention system according to the invention.

The retention/detention system of the invention is comprised of a below ground chamber which is sized according to the particular requirements of the location to accommodate the volume of water requiring storage. A liner system is provided to envelope the retention/detention system and to separate local soils from the porous aggregate.

The chamber configuration is formed with perimeter support structures which are comprised of stabilized porous aggregate. The use of perimeter structures comprised of stabilized porous aggregate substantially reduces the area of the roof structure by enabling the placement of roof supports inside the perimeter of the liner system. Mechanically stabilized gravity walls or reinforced soil slopes are suitably employed. Along with reducing the roof area these stabilized porous perimeter structures support surface loads and provide significant water storage capacity. Within the stabilized porous aggregate perimeter structures are columns and/or piers which provide support for the roof. The use of appropriate pillars or piers effectively reduces the span of the roof structures over the retention/detention chamber. The pillars and/or piers may be stabilized porous structures similar to the perimeter structures or the pillars and/or piers can be constructed of conventional materials including metal, reinforced concrete and the like. Where possible it is preferred to employ pillars and/or piers of stabilized porous construction by reason of increased water storage capacity. The pillars and/or piers provide support to the chamber roof permitting use of the surface above the roof for various purposes including automobile use. When constructed with porous aggregate the pillars and/or piers also provide significant internal water storage capacity.

A suitable roof, illustratively of the deck or arch system type is provided which is supported on the peripheral structures and on the piers or columns, by conventional supporting means.

The water retention/detention system is built below grade, typically within a bed dug in the earth with a substantially flat bottom surface. A liner system is installed over the excavation effective to prevent the passage of particulates into the water retention system. Within the liner system columns/pillars/piers or other such structures are constructed. Around the perimeter and facing the columns/pillars/piers a stabilized structure is provided with a porous backfill. The stabilized perimeter structures include a facing system to prevent aggregate backfill from raveling into the chambers. The stabilization materials/method enable the construction of a vertical face or steep slope or combination thereof. The roof of the chamber spans between singular or multiple columns/pillars/piers and the surrounding perimeter structure.

The dimensions and spacing of the components of the present invention are based on the water storage requirements and economics for a given application. Optimizing the dimensions and spacing of the components is readily determined by the skilled worker.

The perimeter structures are constructed of porous open graded aggregate having a particle size of at least 2 mm, containing not more than a trace (up to 5 wt %) of fines. Smaller size aggregate would result in pore pressures which might destabilize the perimeter structures and in turn the roof structure as well as resulting in lower storage capacity. Each perimeter structure is stabilized to withstand lateral earth and water pressures, including any live and dead load surcharge, the self weight of the structure, temperature and shrinkage effects and earthquake loads. Stabilization is provided by geotextiles, geogrids, geocells, geosynthetic tubes, geosynthetic circular cells or geosynthetic gabions although the present invention is not limited to such materials. The method or methods of stabilization may be selected based on economics and the desired features of the invention. The construction of the stabilized perimeter structures is accomplished by procedures which are by now well known in the art. In this regard, the stabilized perimeter structures can be built using the procedures generally used in MSEW/RSS construction. A description of MSEW and RSS construction is provided for example, in U.S. Department of Transportation Publication No. FHWA-SA-96-071 the disclosure of which is incorporated herein by reference.

Other construction methods include geosynthetic cell structures where geosynthetics are formed into a loop with a strong seam and filled with aggregate.

Still further, geocell construction can be used. These are three dimensional geosythetics which can be expanded to form cells. Perimeter structures can be built by filling the cells with aggregate and stacking one on top of another.

The columns/pillars/piers within the perimeter structures may be backfilled with a porous material and stabilized. Column/pillars/piers can be built using MSEW/RSS construction procedures with appropriate modifications to accommodate two faces in the case of piers or four faces in the case of square columns. The method of stabilization may or may not be similar to that used on the perimeter structures and will depend on the economics and desired features of the columns/pillars/piers.

The facing system allows for water flow such that pore pressures are substantially reduced or eliminated within the porous fill. The material at the face of the structures may be the sole stabilizing element as would be the case with geosynthetic cells. The face may be constructed of geotextiles or geogrids with form work as is common in the construction of stone facade or temporary mechanically stabilized earth walls reinforced with geosynthetics. The face may be constructed with facing panels or facing units. The face may be the exterior component of a geocell. The present invention is not limited to such materials and the means of constructing the face may be selected based on economics and the desired features of the invention.

The stabilization materials and methods described above are from the family of construction product materials known as geosynthetics which are relatively new in the civil engineering industry. Geosynthetics are plastics used in geotechnical applications. Concrete, metal and wood are the traditional engineering materials used to construct gravity and semi-gravity walls. These materials are more susceptible to degradation than geosynthetics when regularly submersed in water and are more expensive for the application proposed in the present invention.

The backfill used to construct the perimeter structures has the capacity to store and drain water without compromising the structural integrity of the stabilized structures. The backfill can be a coarse sand or larger aggregate with no more that a trace of fine particles. In terms of U.S. Standard Sieve Numbers the backfill material is sized larger than a Number 10 Sieve which correlates to a particle size greater than 2 mm.

The most efficient backfill for a given application will be a function of water storage capacity, permeability, stability and cost. Typically this material will be a processed aggregate that is screened and washed to remove finer particles. In certain areas of the country it may be economical to use course sand with no more than a trace of fines. Other potential backfill materials such as recycled concrete, asphalt or glass are also viable as long as the porosity and structural integrity of the materials are sufficient for the purposes of the invention.

Four considerations when selecting the backfill for the structures in the present invention are; water storage capacity, permeability, stability and cost.

Water Storage Capacity—Generally speaking the larger the aggregate size the higher the percentage of air voids and as a result the higher the water storage potential within the structure.

Permeability—The design must consider the potential for pore pressures developing in the porous structures as a result of a rapid draw down condition. While water is released from the present invention there is the potential for the chambers to drain faster than the porous structures. As this imbalance increases, pore pressures will rise within the porous structures and the stability of the structures will decrease. Permeability, which is a measure of the drainage rate of a soil, increases with aggregate size. Larger aggregate (i.e. that having a size of 2 mm or higher) will provide higher permeability than finer soils (i.e.—fine sands, silts and clays) which can mitigate or eliminate the pore pressures associated with a rapid draw down condition and thus are preferred.

Stability—Increasing the aggregate size increases the percentage of air voids and as a result the water storage capacity and the permeability of the porous structures. However, a higher percentage of air voids may compromise the internal stability of the structure and may impact the cost and method of stabilization.

Cost—The selection of the most efficient backfill should be based on optimizing water storage capacity and permeability at the lowest cost without compromising stability. In areas where rock is available the backfill material is likely to be a processed aggregate that is screened and washed. In places where rock is not locally available, like many coastal areas, course sand may be selected despite its lower storage capacity and permeability.

The back of the perimeter structures will typically abut native soil. A liner system is placed between the porous fill and the soil to resist piping of the surrounding soil into the porous backfill. A liner system will also be used on the floor and where needed on the roof of the present invention to restrict the movement of particulates into the chamber. The liner system may be a geotextile that allows for the movement of water but restricts the movement of particulates. The liner system may be a geomembrane, geosynthetic clay liner or spray on coating that restricts the movement of both water and particulates. Metal, concrete and asphalt may be used to construct the roof of the present invention. These materials by themselves or in combination shall restrict the movement of particulates into the present invention. The present invention is not limited to such materials and the selection of materials may be based on economics and the desired features.

The roof of the present invention illustratively is of a deck or arch system but is not limited to such systems. Bearing pads are suitably constructed at the top of the columns/pillars/piers and the perimeter structures to support the roof system.

Inlet/outlet structures to provide for water flow into and out of the chamber are usually provided. These may enter through the liner system and perimeter structures around the sides or through the roof of the present invention. Inlet structures entering the sides of the structure would typically be pipes. Inlet structures entering through the roof may be roadway storm drains. Where applicable a material shall be placed around the inlet structure such that no particulates flow through the protrusion into the present invention and no storm water flows from the present invention. At the interior face of the perimeter structure inlets are constructed such that the porous fill is retained. Outlet structures are built with the same considerations as the inlet structures. In some applications outlet structures may not be desired and the water stored in the present invention will seep into the native soil though the floor and sides. In applications requiring storm water filtration before discharge, filtration systems may be constructed within the chamber and discharged through the liner system.

Pipes or other such structures may be installed within the porous backfill to optimize storage capacity or improve drainage or enhance maintenance procedures. Scour protection may be necessary at inlets and outlets and at the base of columns/pillars/piers and perimeter structures.

Included among the items thought to be novel and unique are the following:

- The use of aggregate stabilized porous structures to form a water storage chamber or chambers in an underground water storage system.
- The use of aggregate stabilized porous walls/steep slopes to store water in an underground storage system.
- The use of aggregate stabilized porous columns/pillars/piers to store water in an underground water storage system.
- The use of aggregate stabilized porous perimeter structures and columns/pillars/piers to support a roof in an underground water storage system.
- The use of aggregate stabilized porous columns/pillars/piers and aggregate stabilized porous perimeter structures to support a roof in an underground water storage system.

Accompanying FIG. 1 is perspective view of a water retention chamber in accordance with the invention.

Referring to FIG. 1, an excavation of a suitable size for the anticipated volume of water to be detained is prepared having a generally level bottom. Liner 1 comprised of a geomembrane is placed over the excavation surfaces.

The four sides of the excavation are sloped as indicated and mechanically stabilized perimeter support structures 2 are constructed in accordance with conventional procedures. Stabilization of the perimeter structures is provided by geosynthetic inclusions 3 in accordance with known practices.

Support columns 4 are provided in sufficient number such that with the perimeter support structures adequate support is provided for roof 5 and the additional anticipated load such as vehicular traffic which is to be born. As shown in FIG. 1, the support columns 4 are also mechanically stabilized earth structures although they may be constructed of any suitable materials. As shown supplemental roof support means 6 are also provided.

Inlet storm drain lines 7 are provided to pass surface rain water into the detention chamber and outlet discharge line 8 is provided to discharge stored water from the chamber. It should be noted that discharge line capacity should be smaller than the inlet line capacity to provide for storage retention.

After the roof 5 has been erected in place, the liner is extended from the perimeter of the excavation to the perimeter of the roof. This area is then backfilled up to grade level. The area above the chamber then can be used as desired, e.g. for vehicle parking or the like.

The columns/pillars/piers 4 can be of any suitable cross-section. For example, columns having circular, rectangular, or other cross-section can be used. Columns having a pyramidal shape as illustrated are especially useful.

Figure 2:
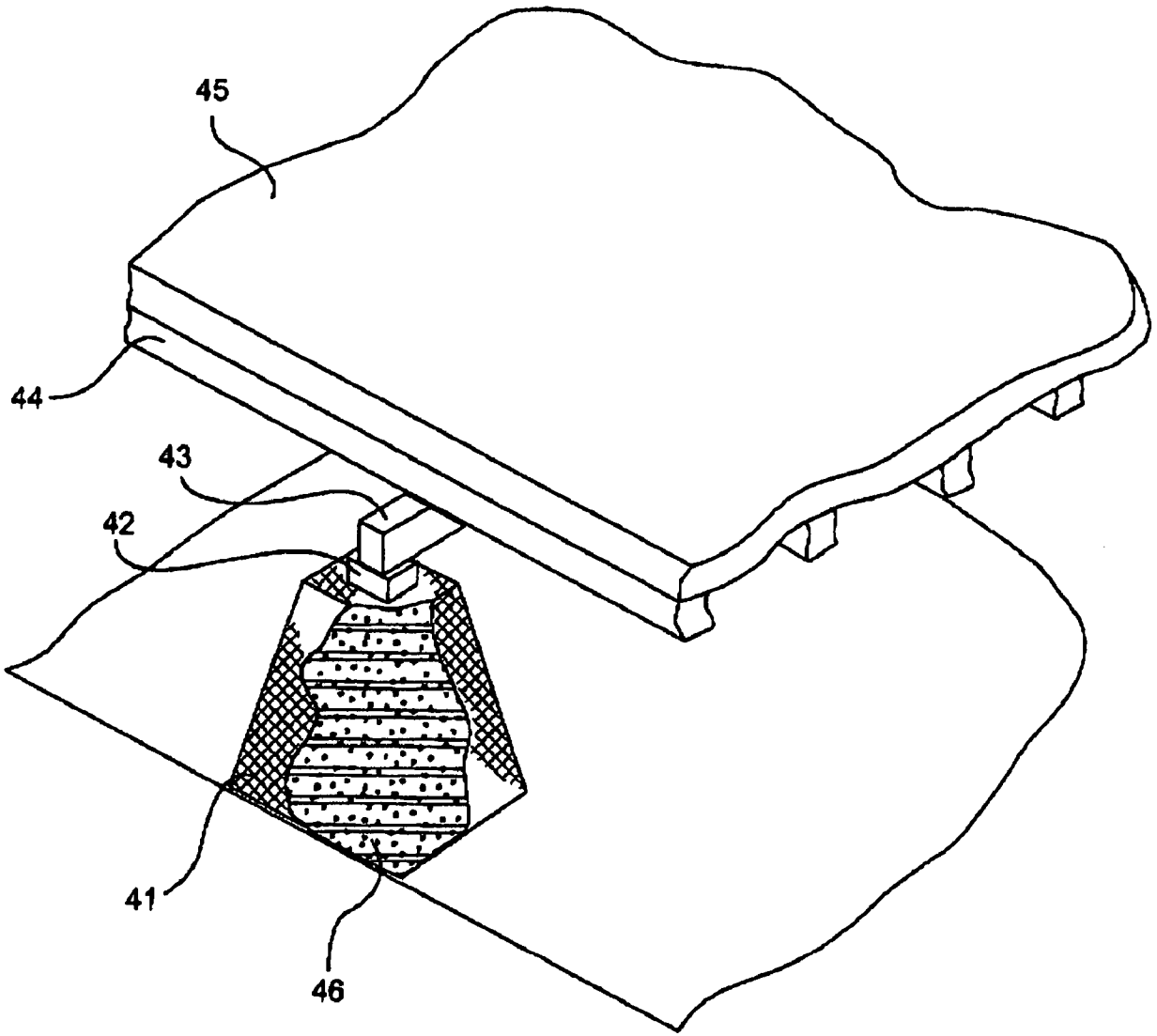
FIG. 2 illustrates a preferred support column such as is employed with the system which is shown in FIG. 1.

FIG. 2 provides an enlarged view of preferred support columns such as are used in FIG. 1 and referred to therein as columns 4. As shown in FIG. 2, column 4 is constructed of open porous aggregate 46. The aggregate is prevented from raveling into the chamber by wrapping the face of the columns in successive lifts with geosynthetic material 47 which are illustratively geotextile or geogrid. In preferred practice tensile reinforcement elements or inclusions are provided to afford increased strength to the structure. Bearing pad 42 is provided upon which beams 43 rest and stringers 44 are provided along the length of the beams with deck 45 resting on the stringers.

Figure 3:
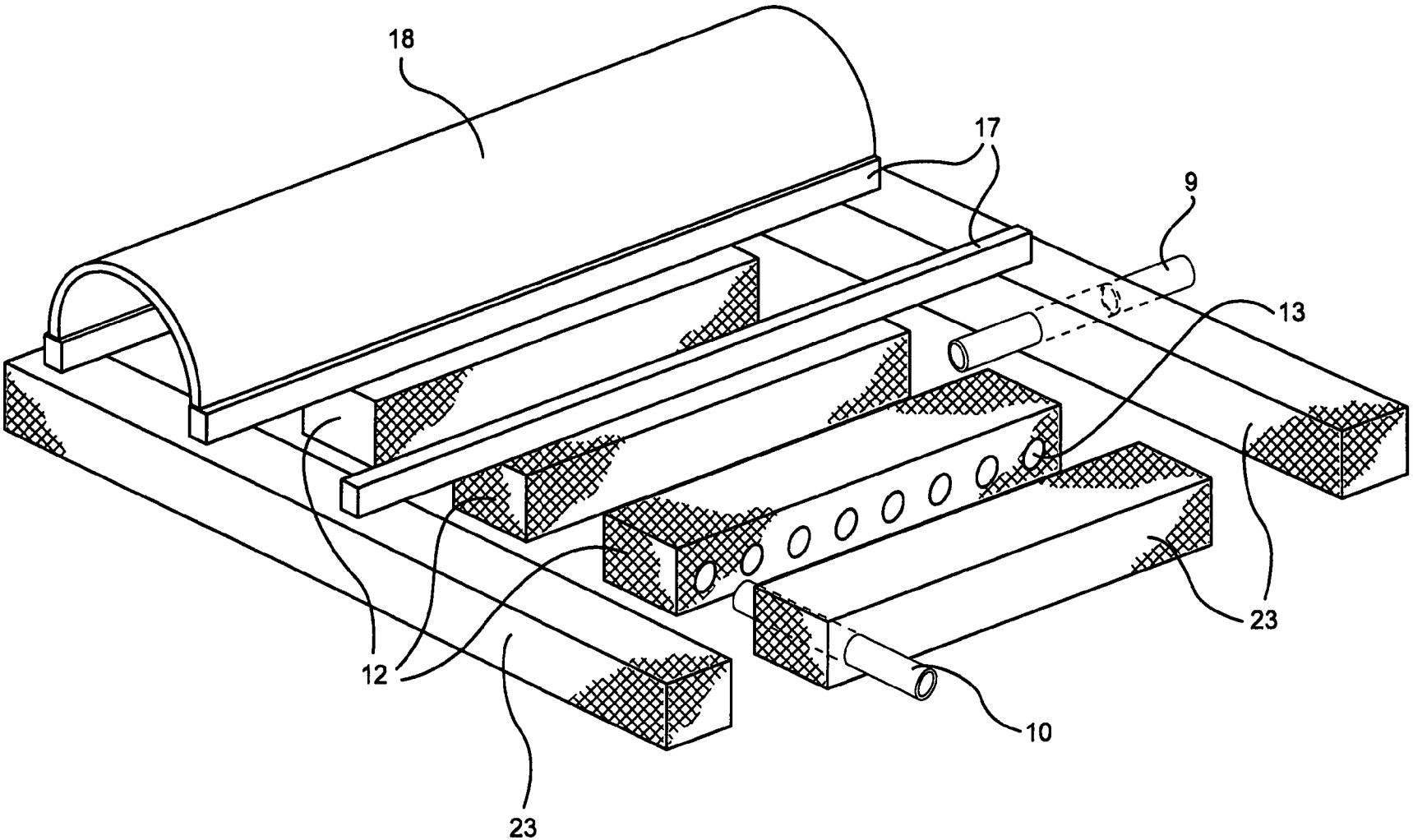
FIG. 3 is an isometric view illustrating various elements of a retention/detention system according to the invention with interior piers and arch roof.

FIG. 3 illustrates an exploded view of a suitable retention/detention chamber comprised of internal bearing piers 12 to support arch roof elements 18 which rest on bearing elements 17. The support piers illustratively have interior conduits 13 which enhance drainage and increase storage capacity. Perimeter structures 23 which are stabilized porous structures are provided, pads 17 are provided appropriately on all piers and perimeter structures to support the roof. In FIG. 3, the roof 18 is an arch roof. Support piers 12 are preferably stabilized porous aggregate structures.

Figure 4:
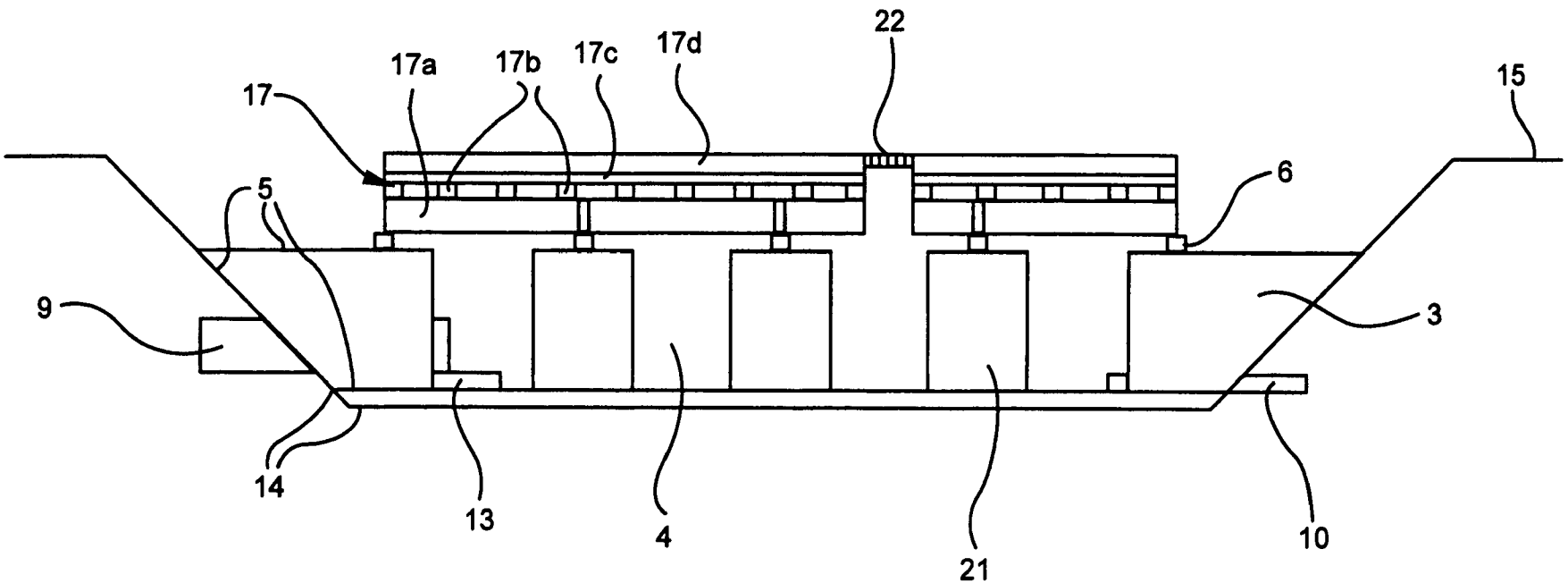
FIG. 4 is an elevation view of a retention/detention system according to the invention with interior columns/pillars and a deck roof.

FIG. 4 is an elevation view of a chamber according to the invention having a deck roof 17 which in turn consists of roof beams 17A, roof stringers 17B, roof planking 17C and roof surface 17D. Support columns 21 are provided. Manhole 22 is provided for access. As described in previous drawings, the walls and support columns are constructed of stabilized porous aggregate.

Figure 5:
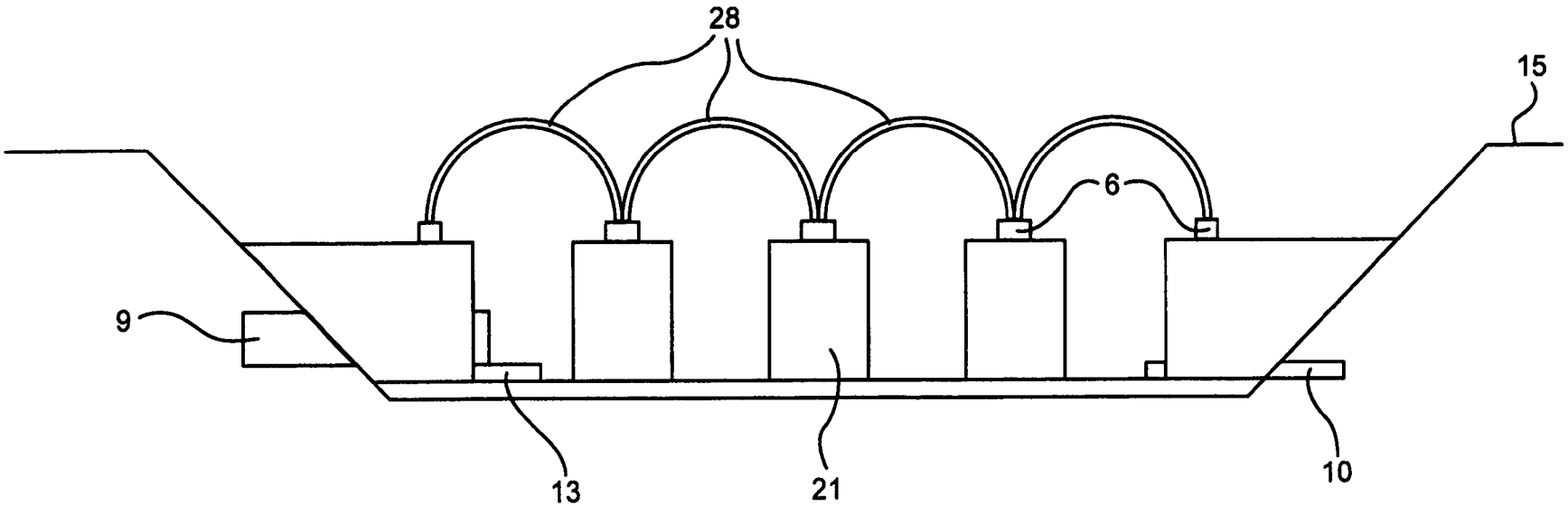
FIG. 5 is an elevation view of a retention/detention system according to the invention with interior piers and an arch roof.

FIG. 5 is an elevation view of a chamber similar to that of FIG. 4 but having an arch roof 28 instead of the deck roof of FIG. 4.

Figure 6:
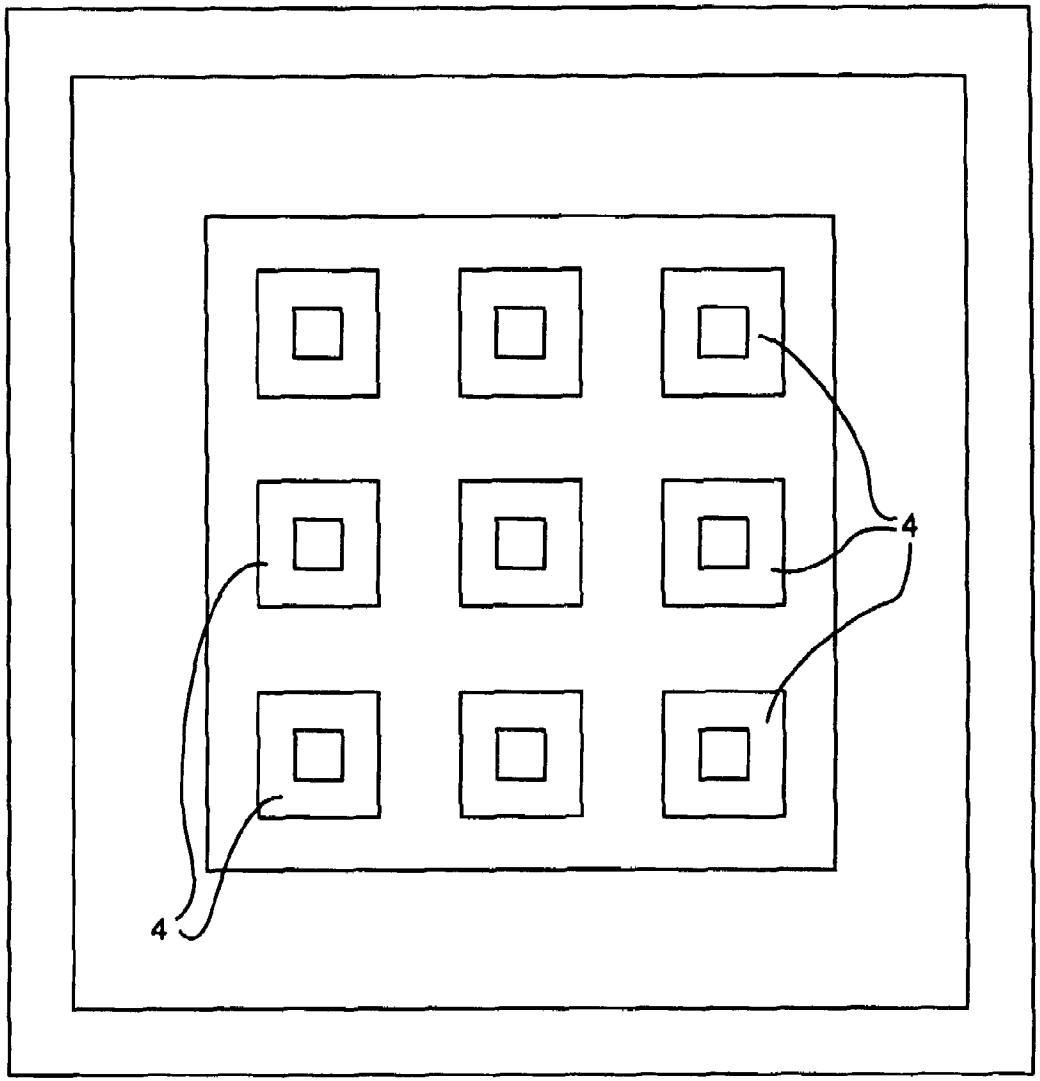
Figure 7:
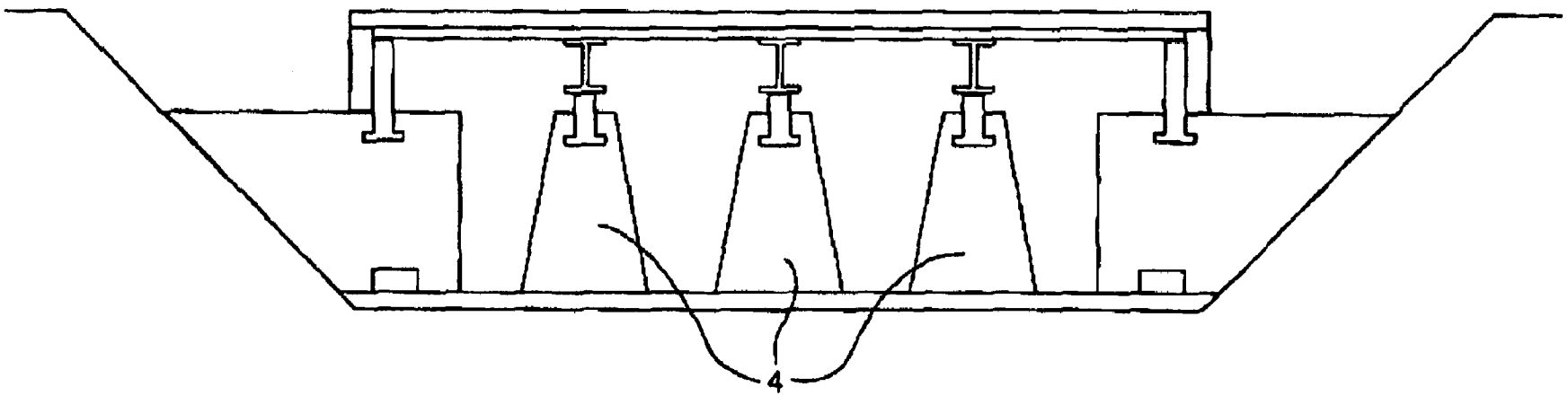
FIG. 7 is an elevation view of the system of FIG. 6.

FIG. 6 is a plan view and FIG. 7 an elevation view of a chamber similar to that of FIG. 1 in accordance with the invention.

FIG. 7 is an elevation view of FIG. 6. In FIG. 7 an elevation view of columns 4 is shown. Columns 4 provide support for the deck roof in addition to that provided by the stabilized porous aggregate perimeter walls.

Figure 8:
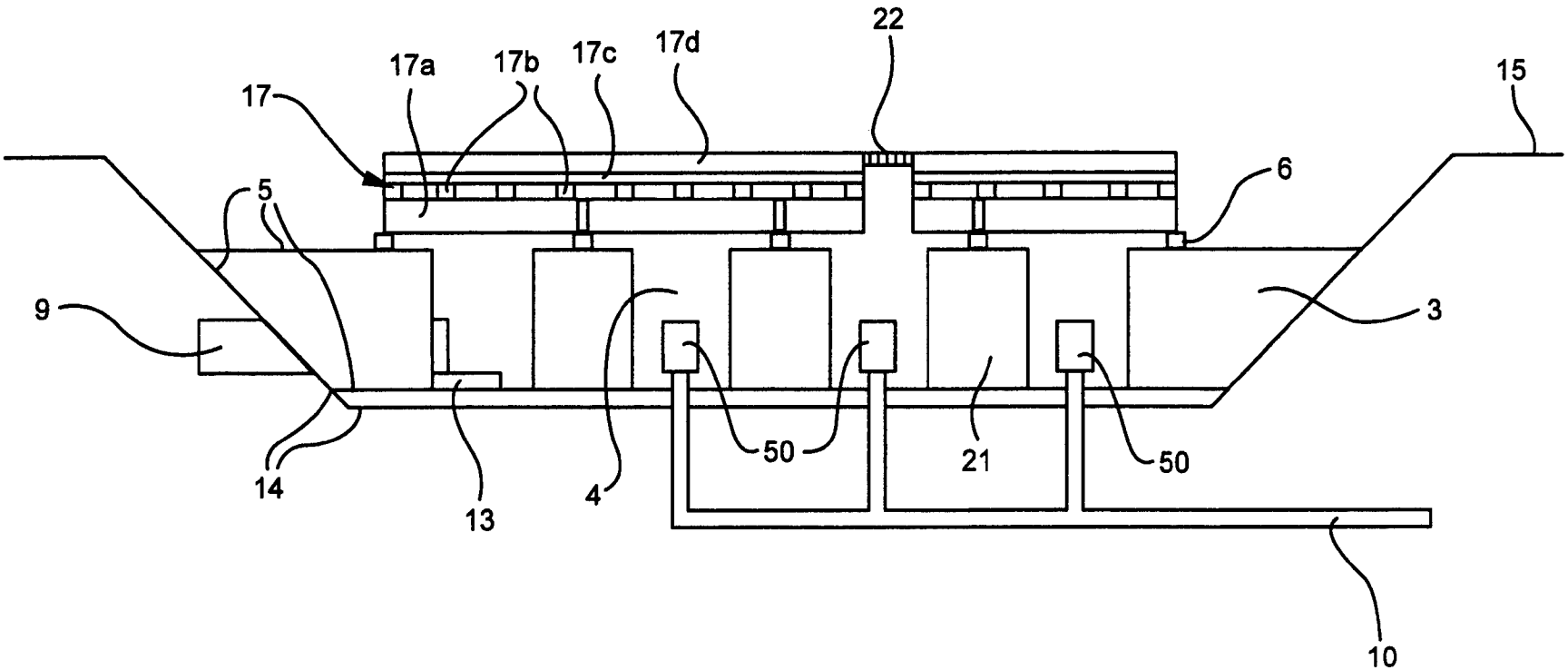
FIG. 8 shows an embodiment of the invention similar to that of FIG. 4 but which includes filtration means within the chamber.

FIG. 8 shows a retention/detention which is similar to that of FIG. 4 but which has filtration means 50 located within the chamber. Water draining from the chamber passes through filtration means 50 before exiting via outlet line 10. The filtration means 50 are of conventional design and are effective to filter undesirable materials from the chamber effluent.

Referring specifically to practice of the invention as shown in FIG. 1 the site for the underground water retention/detention means is excavated to form a pit of an appropriate size, as for example, of a size to detain approximately 90,000 cubic feet of storm water. Generally speaking, a square excavation about 10.5 feet deep having sides 110 long and 1H:1V side slopes is illustrative for such retention/detention. By 1H:1V is meant one horizontal distance unit for one vertical distance unit, i.e. a 45 degree slope angle. The bottom of the excavation is as nearly level as is practical.

The inner surfaces of the excavation, including the bottom are lined with an appropriate geosynthetic material, e.g. geotextile or geomembrane. Perimeter structures 2 are constructed within the excavation, such perimeter structures being mechanically stabilized walls with appropriate inclusions as shown in FIG. 1 of the above referenced FHWA publication.

Support columns are constructed within the excavation of a size and number appropriate to support the roof structure and the anticipated surface load. For example columns having a 12 ft square base and a height of 6 feet are used with a facing system at a 1H:2V batter spaced in a symmetric pattern within the perimeter structure as shown in FIG. 7.

The perimeter structures and columns are constructed with stabilized ¾-2 inch washed, crushed angular stone and stabilized. A geogrid wrap facing system with appropriate aperture dimensions, e.g. ½×½ inch is used to retain the stone. In this example, 9 columns are provided.

Bearing pads made of concrete and steel reinforcing bars are provided at the top of the various columns and deck roof elements are provided which rest on the bearing pads. The deck roof main supports are made of steel and sized to fit on the perimeter walls and bearing pads (about 24 feet spans).

Inlet pipes 9 and outlet pipe 10 are provided having diameters respectively of 3 and 1 feet.

When the chamber assembly is complete, the geosynthetic liner material is extended over the top of the system. Appropriate fill is used to raise the excavated area to the desired grade. The deck roof can be completed and, if required, paved as with asphalt or concrete.

Advantages of the retention/detention chambers of the invention include ease of construction, reduced costs, increased water retention capacity per unit of area above the chambers, and the like. The porous perimeter structures reduce the roof area by enabling the construction of the roof supports inboard of the perimeter liner system. By far the most expensive component of the invention is the roof structure and the cost of the roof rises dramatically as the span between supports increases. A unique feature of the invention is to place structures within the liner system. Otherwise the roof supports would need to be placed outside the liner system/excavation and the span would have to bridge long unreinforced slopes within the excavation. The present invention allows for the roof supports to be placed well inside the liner system perimeter and also enables the construction of a wall/steep slope immediately in front of the roof supports. The space above the excavated slope between the roof supports and the liner system perimeter has limited storage capacity relative to the cost of the roof structure. Consequently it is economical to backfill this space with aggregate that can store water while supporting surface loads and mitigating pore water pressures. The area between the liner system perimeter and the bearing pads borders the entire roof area and as a result constitutes a significant proportion of the invention's surface area.

Where filtration of the retained water is necessary or desirable, filtration means can be provided either within the retention/detention chamber or external of the chamber such that the water exiting the chamber passes through the filtration means before ultimate discharge.

I claim:

1. A water retention/detention chamber comprised of an open chamber formed by stabilized porous aggregate perimeter means and a roof, said roof spanning said chamber and supported by said perimeter means and by support means within the chamber, means for introducing water into said chamber and means for passing water from said chamber, and liner means for preventing passage of particulate matter into said chamber and porous aggregate perimeter means, wherein said perimeter means are disposed inside a perimeter of said liner means, and wherein said roof does not extend beyond said perimeter means.

2. The system of claim 1 wherein the stabilized porous aggregate perimeter means are mechanically stabilized earth walls or reinforced soil slopes.

3. The system of claim 1 wherein the support means within said system comprise mechanically stabilized earth structures.

4. The system of claim 1 wherein the roof is a deck roof.

5. The system of claim 1 wherein the roof is an arch roof.

6. The system of claim 1 wherein the said liner means is at least one of a geotextile, a geomembrane, a geosynthetic clay, or a spray on coating.

7. The system of claim 1 wherein the said perimeter means are stabilized with geosynthetic materials.

8. The system of claim 1 wherein the said support means are stabilized with geosynthetic materials.

9. The system of claim 1 wherein the stabilized porous aggregate perimeter means comprise stabilized porous aggregate having a particle size of at least 2 mm with no more than a trace of finer particles.

10. The system of claim 1 wherein means for water filtration is constructed within said chamber.

11. The system of claim 1, wherein the said perimeter means are stabilized with gabions.

12. The system of claim 1, wherein the said support means are stabilized with gabions.

13. A water retention/detention system, comprising:

a perimeter support structure comprising a stabilized porous aggregate and stabilized by geosynthetic materials;

a roof at least partially supported by the perimeter support structure, the perimeter support structure and the roof defining a chamber therebetween; and at least one inlet configured to allow water to enter into the chamber.

14. A water retention/detention system, comprising:

a perimeter support structure comprising a stabilized porous aggregate;

a roof at least partially supported by the perimeter support structure, the perimeter support structure and the roof defining a chamber therebetween;

at least one roof support disposed within the chamber, wherein the at least one roof support is stabilized by geosynthetic materials; and at least one inlet configured to allow water to enter into the chamber.

15. A water retention/detention system, comprising:

a perimeter support structure comprising a stabilized porous aggregate;

a roof at least partially supported by the perimeter support structure, the perimeter support structure and the roof defining an open chamber therebetween, wherein the roof spans the open chamber;

at least one inlet configured to allow water to enter into the chamber; and a liner configured to prevent passage of particulate matter into the chamber and the perimeter support structure, wherein the perimeter support structure is disposed inside a perimeter of the liner, and wherein the roof does not extend beyond the perimeter support structure.

16. The system of claim 15, wherein the stabilized porous aggregate has a particle size of at least 2 mm and containing not more than up to 5% by weight of fines.

17. The system of claim 15, wherein the perimeter support structure is stabilized by at least one of a mechanically stabilized earth wall or a reinforced soil slope.

18. The system of claim 15, wherein the perimeter support structure is stabilized by geosynthetic materials.

19. The system of claim 15, wherein the perimeter support structure is stabilized with one or more gabions.

20. The system of claim 15, wherein the roof comprises at least one of metal, concrete, or asphalt.

21. The system of claim 15, further comprising:

at least one roof support disposed within the chamber.

22. The system of claim 21, wherein the at least one roof support is stabilized with inclusions.

23. The system of claim 21, wherein the roof support further comprises:

at least one of a column or a pier.

24. The system of claim 21, wherein the roof support is comprised of a stabilized porous aggregate having a particle size of at least 2 mm and containing not more than up to 5% by weight of fines.

25. The system of claim 24, wherein the roof support further comprises a facing system configured to prevent the porous aggregate from entering the chamber.

26. The chamber of claim 21, wherein the roof support comprises at least one of a mechanically stabilized earth structure or a reinforced soil slope structure.

27. The system of claim 21, wherein at least one roof support is stabilized by geosynthetic materials.

28. The system of claim 21, wherein at least one roof support is stabilized with one or more gabions.

29. The system of claim 21, wherein the roof support is stabilized by at least one of metal or concrete.

30. The system of claim 15, wherein the liner further restricts the movement of water into or out of the chamber and the perimeter support structure.

31. The system of claim 15, wherein the liner comprises at least one of a geotextile, a geomembrane, a geosynthetic clay, or a spray on coating.

32. The system of claim 15, wherein the perimeter support structure further comprises a facing system configured to prevent backfill from entering the chamber.

33. The system of claim 15, further comprising:

a bearing pad disposed between the perimeter support structure and the roof.

34. The system of claim 15, further comprising:

an outlet configured to allow water to exit from the chamber.

35. The system of claim 15, wherein the inlet structure further comprises a material configured to prevent particulate from entering the chamber.

36. The system of claim 15, further comprising:

a filtration system for providing filtration of retained water.

37. A water retention/detention chamber comprised of a chamber formed by stabilized porous perimeter means and a roof, said roof supported by said perimeter means and by support means within the chamber, wherein the said support means are stabilized with gabions, means for introducing water into said chamber and means for passing water from said chamber, and liner means for preventing passage of particulate matter into said chamber and porous perimeter means.

38. The system of claim 1, wherein the stabilized porous aggregate perimeter means are stabilized with inclusions.

39. The system of claim 1, wherein the support means are stabilized with inclusions.

40. The system of claim 15, wherein the perimeter support structure is stabilized with inclusions.

41. A method of constructing an underground water retention/detention system, comprising:

forming a perimeter support structure comprising a stabilized porous aggregate below a final surface grade;

disposing a roof supported by the perimeter support structure, the perimeter support structure and the roof defining an open chamber therebetween having the roof spanning the open chamber;

forming at least one inlet configured to allow water to enter into the chamber; and disposing a liner atop a floor of the open chamber and between the perimeter support structure and surrounding soil to prevent passage of particulate matter into the chamber and the perimeter support structure.

42. The method of claim 41, further comprising:

disposing one or more columns or piers within the chamber and atop the liner to further support an interior portion of the roof.

43. The method of claim 41, wherein forming the at least one inlet further comprises:

forming an inlet in the roof.

44. The method of claim 41, wherein forming the at least one inlet further comprises:

forming an inlet through the liner.

45. The method of claim 41, wherein disposing the roof over and at least partially supported by the perimeter support structure further comprises:

disposing the roof flush with the final surface grade.

46. The method of claim 41, wherein disposing the roof over and at least partially supported by the perimeter support structure further comprises:

disposing the roof below the final surface grade.

47. The method of claim 41, further comprising:

backfilling the top of the perimeter support structures outboard of the roof to a desired grade.

* * * * *